US006033097A

United States Patent [19]

Harwood

[11] Patent Number: 6,033,097

[45] Date of Patent: Mar. 7, 2000

[54] TRACK LIGHTING SYSTEM AND LIGHTING TRUSS FOR USE THEREIN

[76] Inventor: Ronald P. Harwood, 31110 Applewood, Farmington Hills, Mich. 48331

[21] Appl. No.: 08/943,636

[22] Filed: Oct. 3, 1997

[51] Int. Cl.[7] ..... F21V 21/02

[52] U.S. Cl. ..... 362/404; 362/147; 439/110; 439/116; 439/119; 52/731.7

[58] Field of Search ..... 52/58, 731.7, 737.6; 362/404, 147; 439/110, 116, 117, 118, 119

[56] References Cited

U.S. PATENT DOCUMENTS

| | | | |
|---|---|---|---|
| 2,503,413 | 4/1950 | Ressinger | 211/135 |
| 2,978,573 | 4/1961 | Kalbrunner | 362/147 |
| 3,584,795 | 6/1971 | Baird | 362/396 |
| 3,649,951 | 3/1972 | Routh et al. | 439/117 |
| 4,471,415 | 9/1984 | Larson et al. | 362/250 |
| 4,725,931 | 2/1988 | Burdon | 362/147 X |
| 5,412,552 | 5/1995 | Fernandes | 362/250 |
| 5,413,300 | 5/1995 | Hosteing | 248/317 |
| 5,423,154 | 6/1995 | Maylon et al. | 52/371 |

OTHER PUBLICATIONS

Nokia Aluminium; "2–Circuit Lighting Track System"; Nokia Aluminium; OEM/Distributor Manual Ver. 1.2 1995; Sect. 3, p. 1; Sect. 4, p. 3; and Sect. 7, p. 4.

*Primary Examiner*—Laura K. Tso
*Attorney, Agent, or Firm*—Marshall & Melhorn

[57] ABSTRACT

A track lighting system which uses a lighting truss which separates the support function from the electrical connection function is provided. A lighting truss is shown which consists of a longitudinally extending base portion having at least an upstanding flange projecting from one side, and an upstanding wall projecting from the other side. A piece of lighting track is mounted on the vertical wall portion, and a beam clamp fastens a luminaire to the longitudinally extending base portion. The upstanding flange will prevent the luminaire from falling off should it loosen in use.

34 Claims, 6 Drawing Sheets

TRACK LIGHTING SYSTEM AND LIGHTING TRUSS FOR USE THEREIN

BACKGROUND OF THE INVENTION

1. Field of the Invention

The present invention deals with lighting systems. More particularly, the present invention deals with lighting systems known in the art as track lighting systems. Most particularly, the present invention deals with an improved track lighting system, and an improved lighting truss for use therein.

2. Description of the Prior Art

Track lighting systems for providing illumination of displays in retail and other establishments are well known. Such lighting tracks not only provide an electrical connection to a light fixture, but through adaptors mounted to the light fixtures, actually provide the support function as well. One such known lighting track system is the TEK Surface Mount Lighting System from Nokia Aluminum of P.O. Box 117, FIN-02401, Kirkkonummi, Finland.

Lighting tracks may be surface mounted using fasteners such as screw mounts or ceiling clamps, suspended using a suspension wire or suspended rod and tube, or utilize a recessed mounting. An end feed supplies electrical current to the track, with the track body usually serving as ground, and with various arrangements of live and neutral wires contained within the track which provide an electrical connection to the lighting fixture through the track adaptor.

Such track lighting systems generally work well in most instances, but problems arise in applications where a large amount of light is needed relative to the square foot area of the retail establishment. These problems occur because of a combination of factors, most notably the design of track lighting fixtures, which are fed power normally from their end or center, and the manner in which electrical codes rate the total amount of power permitted in a store, and the track.

Generally, electrical codes, although they vary throughout the country, will require rating a track lighting system at a given amount of watts per lineal foot of track. A common number is 90-watts per lineal foot. Since track lighting systems, by their design, are either fed from their end or center, quite some length of track may be necessary to place the track in a position where lighting is desired, and to provide the necessary flexibility. Since each foot of track that is placed in the store will be rated at 90-watts per foot, if the retail store is of the type which requires a lot of track to achieve the necessary lighting, a rating of a large number of watts is quite possible.

However, this large wattage rating causes a problem with another portion of the electrical codes, which only allows a retail establishment to have a certain number of watts per square foot for all lighting requirements. Again, the number of watts per square feet of establishment varies, but a common number is 3-watts per square foot, and this 3-watts per square foot number includes all lighting. It can be understood by those skilled in the art that the more wattage that is put into track lighting, the less wattage can be put into other lighting equipment. Thus, those skilled in the art have continued to search for a solution to the problem of how to put enough light into a high-light requirement store without running afoul of other portions of the electrical code.

SUMMARY OF THE INVENTION

In order to solve the above-described problems of long-standing in the art, a track lighting system using a lighting truss which separates the support function from the electrical connection function has been developed. In one modification of the present invention, a lighting beam or truss is provided which consists of a longitudinally extending base portion having an vertical or upstanding flange projecting from one side thereof, and a vertical or upstanding wall projecting from the other side thereof. From the upper extremity of the vertical wall portion projects a lateral platform portion. At the extremity of the laterally extending platform portion is a second vertical or upstanding wall portion.

In another modification of the present invention, a lighting beam or truss is provided having a longitudinally extending base portion, a vertical or upstanding flange projecting from one side thereof, and a vertical or upstanding wall portion projecting from the other side thereof.

In yet a further modification of the present invention, a lighting beam or truss is provided having a base portion extending in a longitudinal direction, an upstanding flange projecting from one side of said base portion, and a vertical or upstanding wall portion projecting from the other side of said base portion. Extending laterally from the upstanding wall portion is a shelf portion having a C-shape channel portion containing or forming a groove.

Thus, it is an object of the present invention to provide an improved track lighting system.

It is a further object of the present invention to provide an improved track lighting system having a lighting beam or truss wherein the electrical connection function is removed from the lighting fixture support function.

A further object of the present invention is to provide a lighting truss having a lighting track centrally mounted thereon.

A still further object of the present invention is to provide a lighting beam or truss wherein a lighting track is centrally mounted thereon and is of a length only approximately one-third the length of the lighting truss.

A still further object of the present invention is to provide a lighting truss which will have an electrical rating lower than a corresponding length of a conventional track lighting system.

Further objects and advantages of the present invention will be apparent from the following description and appended claims, reference being made to the accompanying drawings forming a part of the specification, where in like reference characters designate corresponding parts in the several views.

BRIEF DESCRIPTION OF THE DRAWINGS

FIG. 3-A is an elevational view of the lighting truss shown in FIG. 3.

FIG. 7-A is an end elevational view of the lighting truss shown in FIG. 7.

FIG. 8-A is an end elevational view of the lighting truss shown in FIG. 8.

It is to be understood that the present invention is not limited to the details of construction and arrangement of parts illustrated in the accompanying drawings, since the invention is capable of other embodiments, and is capable of being practiced or carried out in various ways within the scope of the claims. Also it is to be understood that the phraseology and terminology employed herein is for the purpose of description, and not of limitation.

Figure 1:
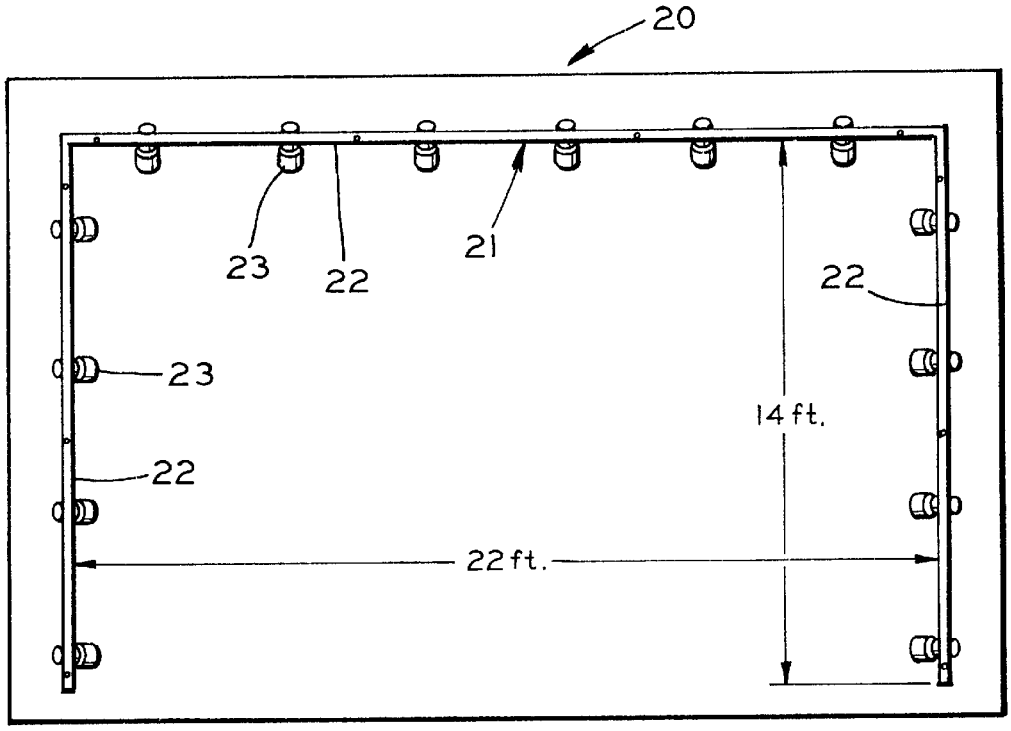
FIG. 1 (PRIOR ART)
FIG. 1 is a diagrammatic plan view of a prior art track lighting system.
Figure 2:
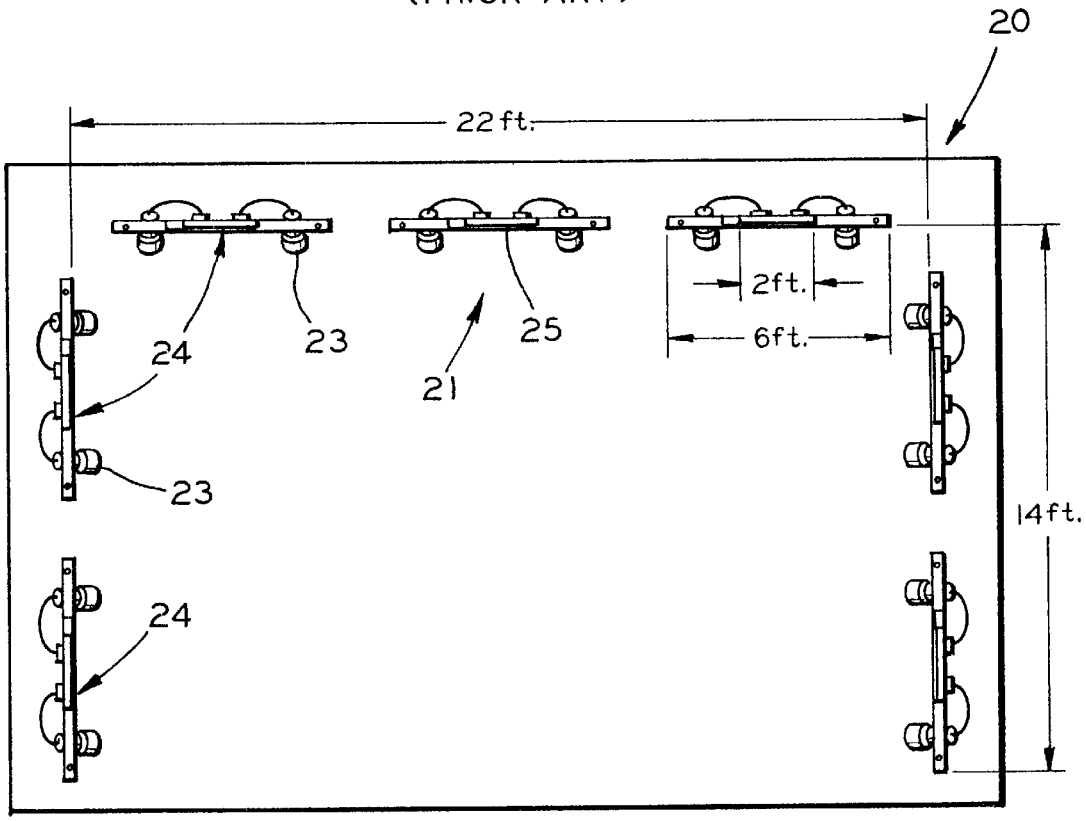
FIG. 2 is a diagrammatic plan view of a track lighting system embodying the construction of the present invention.

Referring now to FIGS. 1 and 2, there is shown a diagrammatic plan view of a retail establishment 20, having the ceiling removed to show the installation of a track lighting system 21 therein. Referring first to FIG. 1, showing the prior art installation, there is shown lighting track 22 installed about the perimeter of a 14 foot by 22 foot area, for example. On the lighting track 22 there are installed fourteen (14) light fixtures 23. At a rating of 90 watts per linear foot of track as per the previous discussion, this installation would be rated at 4,500 watts. For the purposes of these examples, the total wattage allowed for lighting in the retail establishment is disregarded.

This is to be contrasted with the lighting system 21 embodying the construction of the present invention shown in FIG. 2. The same fourteen (14) light fixtures 23 are installed on seven six foot pieces of improved lighting truss 24 embodying the present invention about the same 14 by 22 foot area shown in FIG. 1. However, since each six foot section of improved lighting trust 24 has only two feet of lighting track 40 track 25 installed thereon, this system would be rated at 7×2×90 watts, or 1260 watts, a difference of 3240 watts. This additional 3240 watts is now available for other lighting purposes. The same amount of light can be installed with a rating of only ⅓ the number of watts, thus the advantage of the improved construction of the present invention is clearly obvious. Of course, one must still be careful that the type of lighting fixture chosen does not overload the individual circuits to which the lighting trusses 24 are connected. The advantages are achieved by removing the support function from the electrical connection function.

Figures 3, 3A:
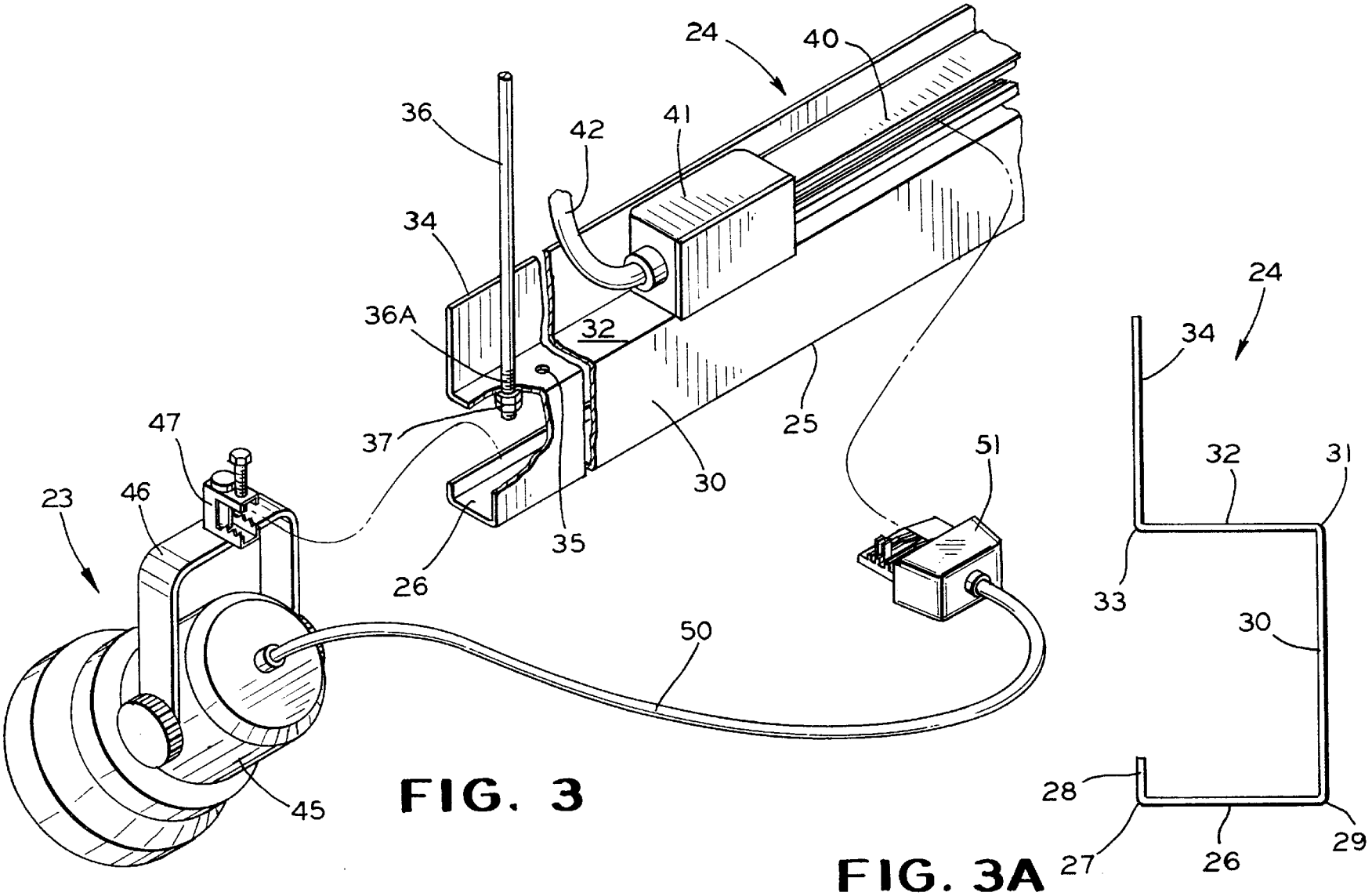
FIG. 3 is an exploded perspective view of a construction embodying the present invention.

Referring now to FIGS. 3 and 3A, improved lighting truss 24 comprises a longitudinally extending beam member 25 having a generally rectangular-shape longitudinally extending base portion 26. Along one lateral or side edge 27 of the base 26 projects an upstanding flange 28. Along the second or other lateral edge region 29 of the base 26 projects an upstanding or vertical wall portion 30.

About the upper extremity 31 of the upstanding or vertical wall 30 projects a laterally extending or platform portion 32, which may extend in a parallel-spaced relationship with the base portion 26. The lateral dimension of the platform portion 32 may also be substantially the same as the base 26, so that the lateral extremity 33 of the platform portion 32 may be spaced approximately above the upstanding flange 28. From this position, a second vertical or upstanding wall portion 34 projects. A plurality of mounting holes 35 are provided in the platform portion 32. Nuts 37 threaded onto threaded portion 36A of rod or tube 36 secures the improved lighting truss 24 in place. It should be understood that the improved lighting truss 24 may also be affixed to the wall or ceiling of the retail establishment by means known in the art, and this would be well within the scope of the present invention.

To supply electrical power to the improved lighting truss 24, a section of electrical track 40 which may be such as the Model XTS4, also manufactured by Nokia Aluminum of Kirkkonummi, Finland, may be secured to the second vertical wall portion 34 of the improved lighting tress 24, preferably proximate the middle thereof. A junction box 41 is connected by way of a short piece of conduit and an end cap (not shown for the purposes of clarity) to the lighting track 40. Flexible connector 42 connects the junction box 41 to a source of current (not shown).

Virtually any lighting fixture 23 may be connected to the improved lighting truss 24. Lighting fixture or luminaire 23 has a housing portion 45 which is pivotally connected or attached to a generally "U-shaped" bracket or yoke 46. A C-shaped beam clamp 47, which is known in the art and may be such as the model number BC beam clamp manufactured by Erico Products, Inc. of Cleveland, Ohio, attaches the yoke 46 to the improved lighting truss 24 in manner to be described below. Wire 50 connects the lamp housing 45 to track adapter 51. Track adaptor 51 connects to the lighting track 40 by means well-known in the art.

The versatility of the present invention can be seen in that the lighting truss of the present invention can accommodate virtually any lighting track 40 which is on the market today. Lighting track 40 made by different manufacturers may require different track adapters 51, but virtually any luminaire 23 can be used with the improved lighting truss 24 simply by placing on the end of wire or cord 50 the proper track adapter 51 for the track 40 mounted to the second vertical wall portion 34 of the beam member 25.

Figure 4:
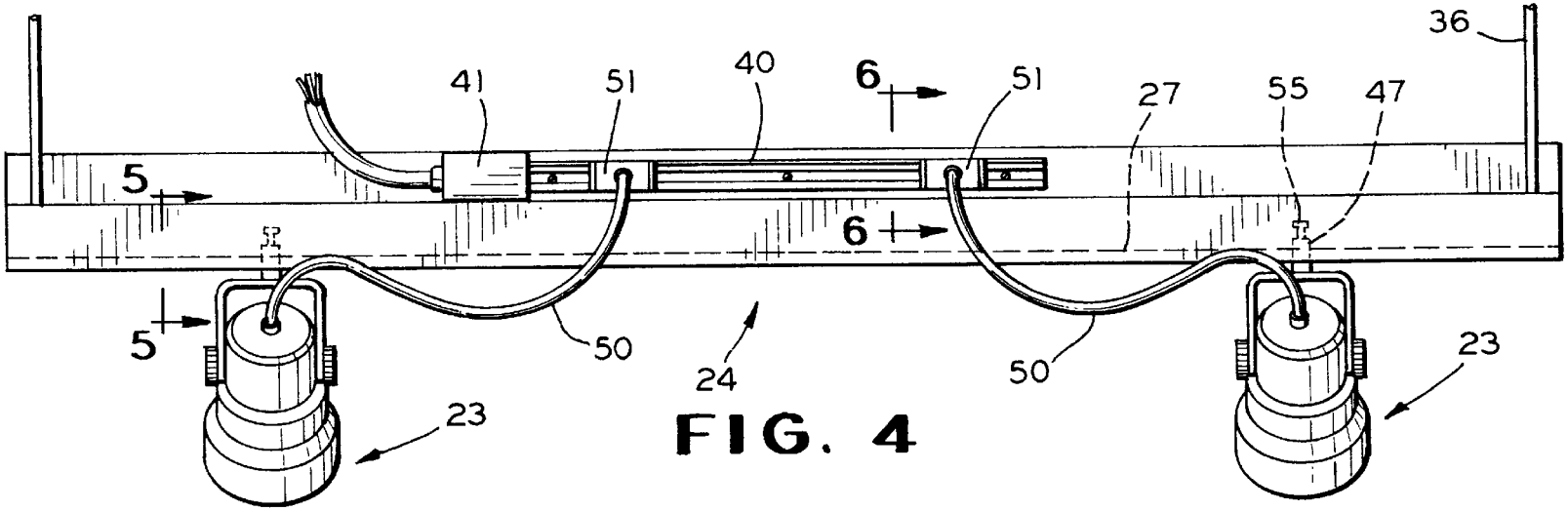
FIG. 4 is an elevational view similar in part to FIG. 3 but showing an entire length of truss supported by truss rods and having two lighting fixtures mounted thereon.
Figure 5:
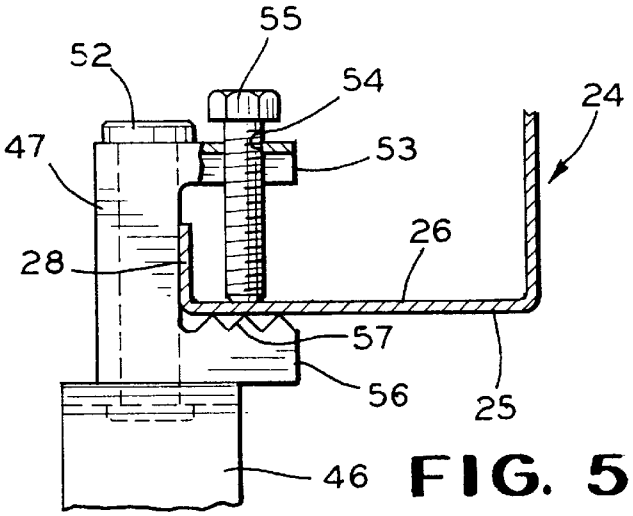
FIG. 5 is a sectional view, taken in the direction of the arrows, along the section line 5—5 of FIG. 4.

Referring now FIGS. 4–6, the mounting of the luminaire 23 to the improved lighting truss of 24 of FIG. 3 will be explained in more detail. Referring first to FIG. 5, it can be seen that the C-shaped clamp 47 is connected to the U-shaped bracket 46 by fastening means 52 such as bolts, screws, rivets or the like. The upper arm 53 of the C-shaped clamp 47 has a threaded opening 54 to accept a bolt 55.

The lower arm 56 of clamp 47 has a saw-tooth gripping portion 57. To mount the luminaire 23 to the beam member 25, the bolt 55 is retracted sufficiently to clear the upstanding lip or flange 28 of the beam member 25. The clamp 47 is slid laterally with respect to the base 26 of the beam member 25 until the throat of the clamp 47 contacts the lip 28 at which time the bolt 55 is tightened against the base 26, forcing the saw-tooth portion 57 on the lower arm 56 of clamp 47 to grip the base 26 and hold the luminaire 23 firmly in place.

Figure 6:
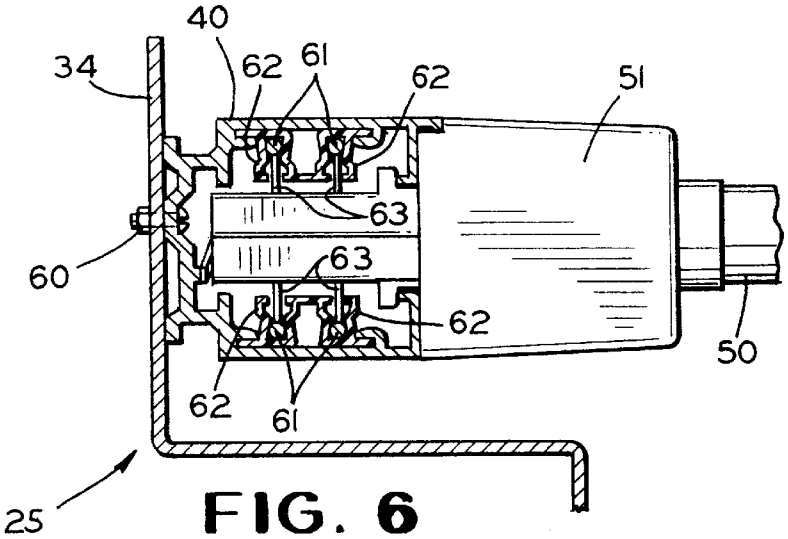
FIG. 6 is a sectional view, taken in the direction of the arrows, along the section line 6—6 of FIG. 4.

The connection of the track adapter 51 to the lighting track 40 is illustrated in FIG. 6. Any lighting track and track adapter can be used and be well within the scope of the present invention. The track 40 is fastened to the second vertical wall portion 34 of the beam member 25 by track fastening means 60, which may be such as bolts, screws, rivets, or the like. The lighting track 40 contains 4 conductors 61 contained inside grooves 62 provided in the track. Blades 63 contained within the track adapter 51 reciprocally engage the conductors 61 by means well-known in the art.

Figure 9:
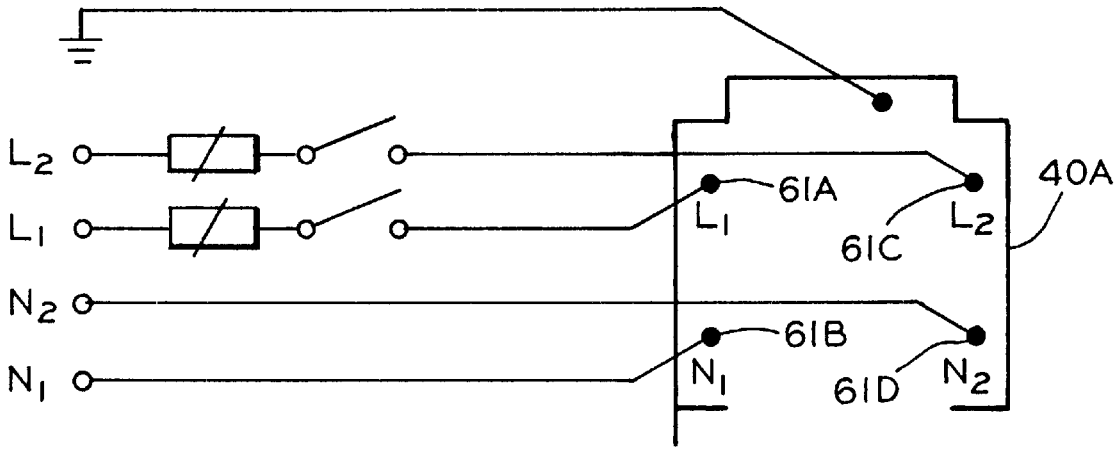
FIG. 9 is a schematic view showing a two circuit wiring diagram for a wiring track such as may be used in the present invention.
Figure 10:
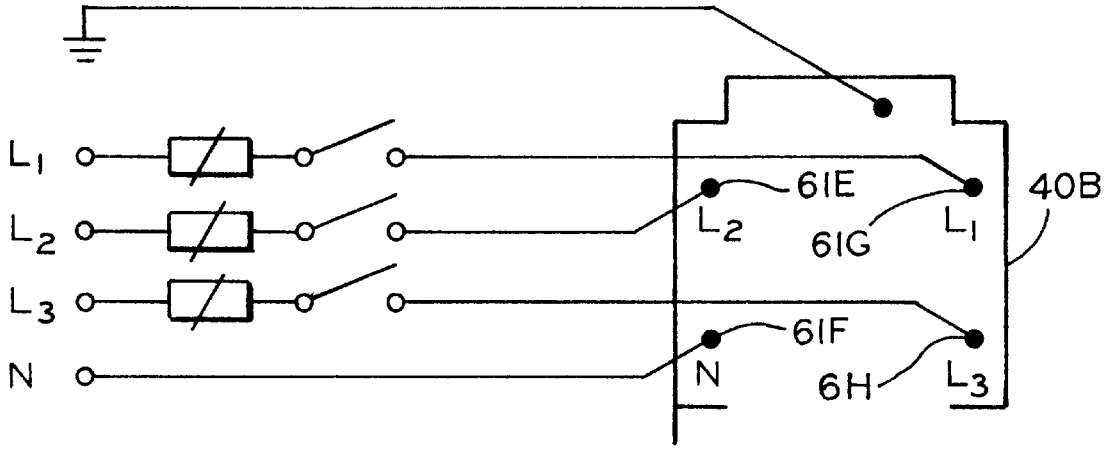
FIG. 10 is a schematic view showing a wiring diagram for a three circuit track such as may be used in the present invention.

Referring to FIGS. 9 and 10, the flexibility of the present invention can be seen. Since the lighting track 40 contained on the improved lighting truss 24 of the present invention may be a one circuit, two circuit, three circuit, or any other type lighting track, and the lighting track 40 on truss does not need to be the same as the lighting track 40 on another truss, many variations are possible using the improved track lighting system of the present invention. Additionally, for example, if a three circuit track is provided, some of the luminaires 23 may have their adapters 51 wired to work off one circuit, while some of the luminaires 23 on the lighting truss may have their adapters 51 wired to work off another circuit.

FIG. 9 illustrates a 2 circuit lighting track 40A. As is customary, the body of track 40A is connected to ground. There are two live conductors (61A, 62C), and correspondingly there are two neutral conductors (61B, 61D).

FIG. 10 shows a schematic diagram of a 3 circuit track, which may be such as the STS or XTSS series track manufactured by Nokia Aluminum. Track 40B again has the body of the track serving as ground. In this version of the track there are three live conductors (61E, 61G, 61H) and one neutral conductor 61F. Any combination of lighting tracks and track adapters may be used and be well within the scope of the present invention.

Figure 7:
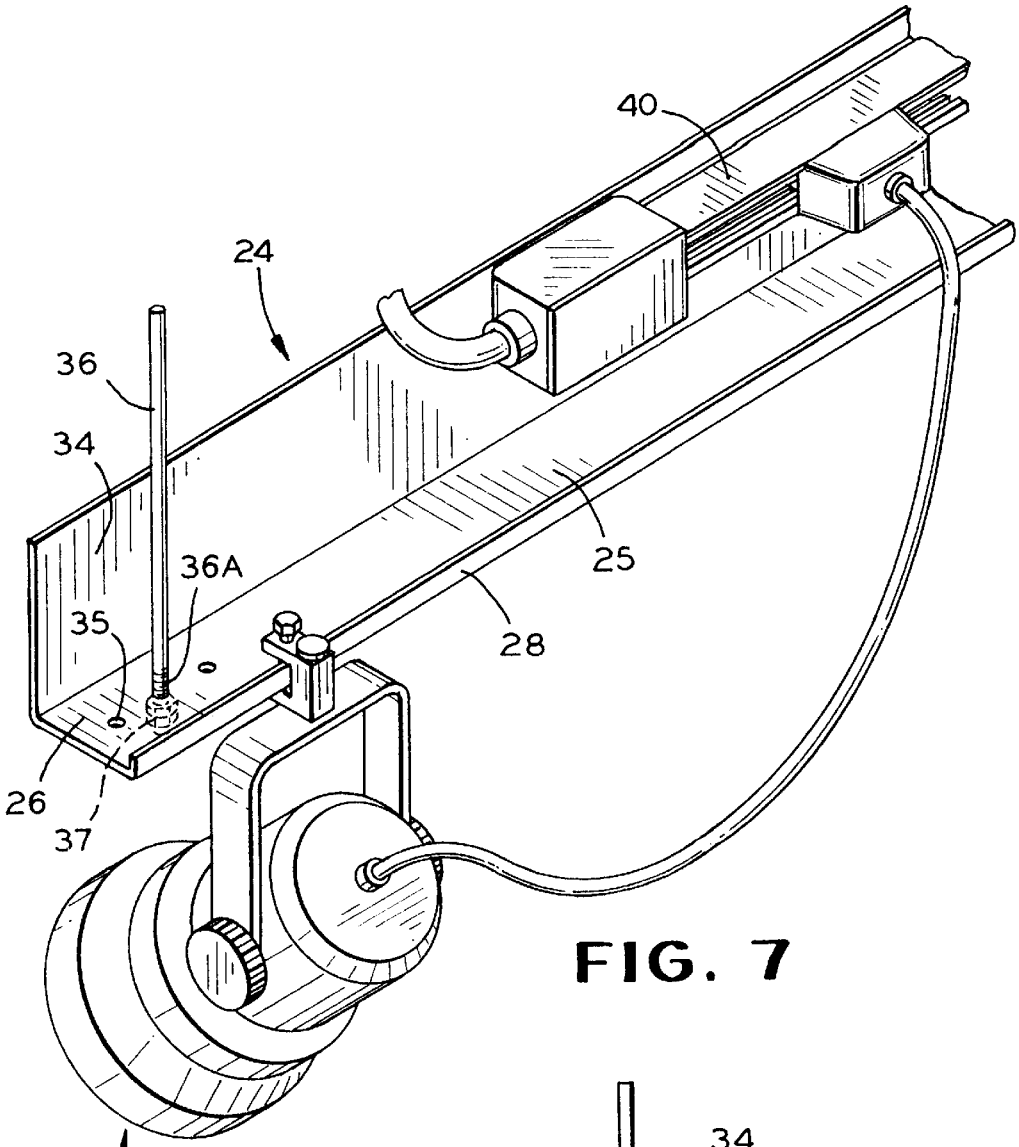
FIG. 7 is a perspective view of a modification of the present invention.
Figure 7A:
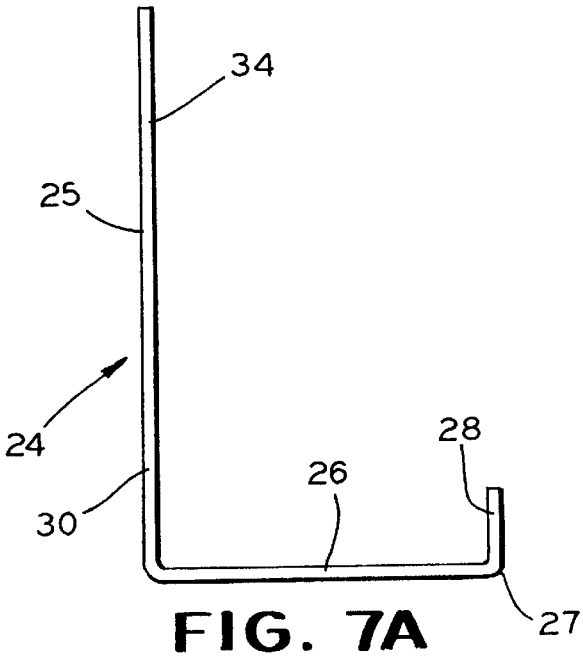

Referring FIGS. 7 and 7A, a modification of the present invention may be seen. The modification consists of a variation in the shape of the improved lighting truss 24. In this case the lighting truss 24 has a beam member 25 having a longitudinally extending base member 26 with a vertical or upstanding flange or lip portion 27 and a first or vertical wall portion 30 only. The mounting holes 35 are provided in the base portion 26 and, as before, rods or tubes 36 having a threaded portion 36A to accept fasteners 37 allow the improved lighting truss 24 to be suspended from the ceiling of the retail establishment. As with the invention shown in FIGS. 3–6, mounting of the beam 25 to the wall or floor of a retail or other establishment by means well-known in the art is well within the scope of the present invention.

Figure 8:
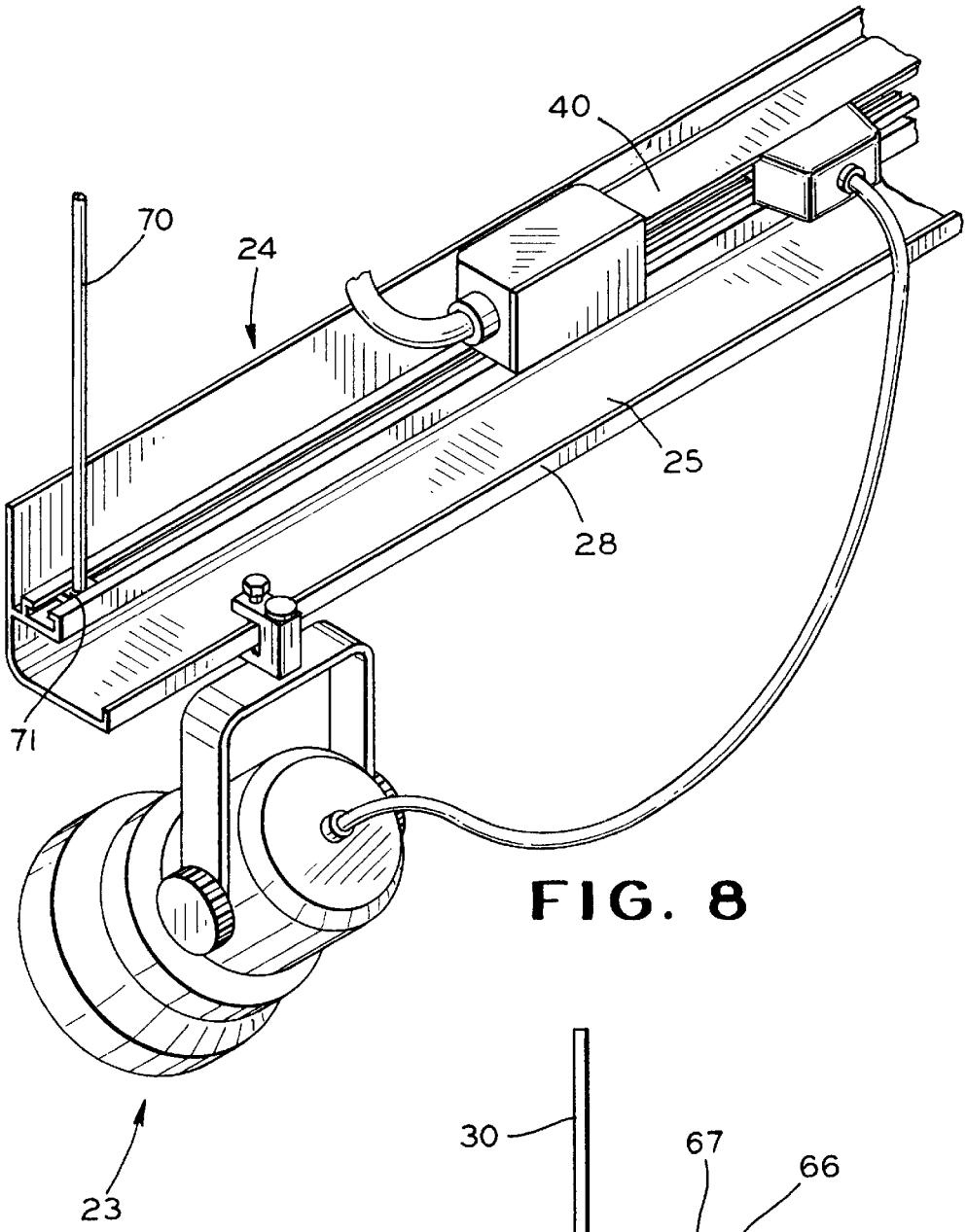
FIG. 8 is a partial perspective view of a construction embodying another modification of the present invention.
Figure 8A:
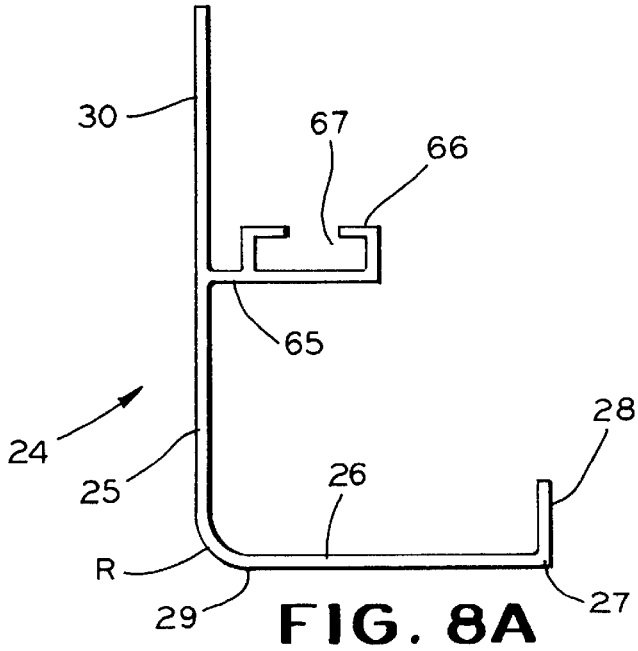

Referring now to FIGS. 8 and 8A, a further modification of the present invention may be seen. In this modification of the invention, the beam member 25 of the improved lighting truss 24 has a longitudinally extending base portion 26 having an upstanding or vertical flange or lip 28 proximate the first or lateral edge region 27 of the base 26. Proximate the second or other lateral edge region 29 of the base 26, is a radius R joining the base 26 to the upstanding or vertical wall portion 30. Proximate the middle of the vertical wall portion 30 is a modified or lateral or platform portion 65. At the extremity of lateral portion 65 is C-shaped channel portion 66, which contains groove 67.

With this modification, a modified mounting rod or tube 70 is used which has in place of the threaded portion previously described a square head portion 71. Head portion 71 fits in groove 67 to suspend the improved lighting truss 24 from the ceiling of the retail or other establishment. The electrical details and the details concerning the attachment of the luminaire to the beam number 25 remain the same as just discussed in connection with the previous embodiments of the invention.

Therefore, by carefully studying the problems in present day track lighting systems there has been developed a novel track lighting system utilizing the problems in present day track lighting systems. There has been developed a novel track lighting system utilizing an improved lighting truss.

What is claimed is:

1. A track lighting system including a plurality of improved lighting trusses, each of said plurality of said improved lighting trusses including:

a) a beam member, said beam member including:
- i) a rectangular, longitudinally extending base portion,
- ii) a flange projecting upwardly from one side of said base portion,
- iii) a vertical wall projecting upwardly perpendicularly from the other side of said base portion,
- iv) a lateral platform portion projecting perpendicularly from one side of said vertical wall portion parallel to and above said rectangular base portion, and
- v) a second vertical wall portion projecting perpendicularly upward from the other side of said lateral platform portion in vertical alignment with said flange.

2. A track lighting system including a plurality of improved lighting trusses, each of said plurality of said improved lighting trusses including:

a) a beam member, each of said beam members including:
- i) a rectangular longitudinally extending base portion, said rectangular longitudinally extending base portion having a plurality of mounting holes therein to accept at least one mounting rod or tube,
- ii) a perpendicular flange projecting upwardly from one side of said longitudinally extending base portion, and
- iii) a perpendicular wall portion projecting upwardly from said longitudinally extending base portion.

3. A track lighting system including a plurality of improved lighting trusses, each of said plurality of said improved lighting trusses including:

a) a beam member for supporting a luminaire and a power take off, each of said beam members including:
- i) a longitudinally extending base portion,
- ii) an upstanding flange projecting from one side of said longitudinally extending base portion,
- iii) an upstanding wall portion projecting from the other side of said longitudinally extending base portion, and connected by a radius,
- iv) a lateral portion projecting perpendicularly from said vertical wall portion, said lateral portion including a C-shaped channel portion forming a groove.

4. An improved lighting truss, said improved lighting truss including a beam member, said beam member including:

a) a longitudinally extending base portion, said rectangular longitudinally extending base portion having a plurality of mounting holes therein to accept at least one mounting rod or tube:

b) a flange projecting upwardly from one side of said longitudinally extending base portion, and c) an upstanding wall projecting from the other side of said longitudinally extending base portion.

5. The device defined in claim 4, and further including:

a) a lighting track mounted to said vertical wall portion, and b) a junction box electrically connected to said lighting track and mounted to said vertical wall portion.

6. The device defined in claim 3, and further including:

a) a plurality of mounting holes provided in said base portion.

7. The device defined in claim 5, and further including a luminaire mounted to said base portion of said beam member over said flange, said luminaire including:

a) a housing, b) a yoke pivotally connected to said housing, c) a beam clamp fixedly mounted to said yoke.

8. The device defined in claim 7 wherein, said beam clamp includes:

a) an upper arm having a threaded opening, b) a bolt carried in said threaded opening and extending downwardly toward, c) a lower arm including a saw tooth gripping portion.

9. The device defined in claim 7, wherein said luminaire includes:

a) a lamp, b) a cord electrically connected to said lamp, and c) a track adaptor electrically connected to said cord and engaging said lighting track.

10. The device defined in claim 9, wherein said lighting track is a one circuit track.

11. The device defined in claim 9, wherein said lighting track is a two circuit track.

12. The device defined in claim 9, wherein said lighting is a three circuit track.

13. An improved lighting truss, said improved lighting truss including a beam member, said beam member including:

a) a longitudinally extending base portion, b) a flange projecting from one side of said longitudinally extending base portion, c) an upstanding wall projecting from the other side of said longitudinally extending base portion, d) a lateral platform portion projecting perpendicularly from one side of said upstanding wall portion parallel to and above said rectangular base portion, and e) a second vertical wall portion projecting vertically upward from the other side of said lateral platform portion in vertical alignment with said flange.

14. The device defined in claim 13, and further including:

a) a lighting track said mounted to said second vertical wall, and b) a junction box electrically connected to said lighting track and mounted to said second vertical wall portion.

15. The device defined in claim 14, and further including:

a) mounting holes provided in said base portion.

16. The device defined in claim 14, and further including a luminaire mounted to said base portion of said beam member over said flange, said luminaire including:

a) a housing portion, b) a yoke pivotally mounted to said housing portion, and c) a beam clamp fixedly mounted to said yoke.

17. The device defined in claim 16, wherein said beam clamp includes:

a) an upper arm having a threaded opening, b) a bolt carried in said threaded opening and extending downwardly toward, c) a lower arm including a saw tooth gripping portion, said beam member captured between said bolt and said saw tooth gripping portion.

18. The device defined in claim 16, wherein said luminaire includes:

a) a lamp, b) a cord electrically connected to said lamp, and c) a track adaptor electrically to said cord and engaging said lighting track.

19. The device defined in claim 18, wherein said lighting track is a one circuit track.

20. The device defined in claim 18, wherein said lighting track is a two circuit track.

21. The device defined in claim 18, wherein said lighting track is a three circuit track.

22. An improved lighting truss including a beam member for supporting a luminaire and a power take off, said beam member including:

a) a longitudinally extending base portion, b) a flange projecting upwardly from one side of said longitudinally extending base portion, c) an upstanding wall portion projecting from the other side of base portion and connected by a radius, and d) a platform portion extending perpendicularly from said upstanding wall portion, said platform portion including a C-shaped channel portion.

23. The device defined claim 22, and further including:

a) a lighting track mounted to said vertical wall portion, and b) a junction box connected to said lighting track and mounted to said vertical wall portion.

24. The device defined in claim 23, and further including a plurality of rods having square head portions engaging a groove formed by said channel portion to support said improved lighting truss.

25. The device defined in claim 23, and further including a luminaire mounted on said longitudinally extending base portion of said beam member over said flange, said luminaire including:

a) a housing portion, b) a yoke pivotally connected to said housing portion, and c) a beam clamp mounted to said yoke.

26. The device defined in claim 25, wherein said beam clamp includes:

a) an upper arm having a threaded opening, b) a bolt carried in said threaded opening and extended downwardly toward, c) a lower arm including a saw tooth gripping portion, said beam member captured between said bolt and said saw tooth gripping portion.

27. The device defined in claim 25, wherein said luminaire further includes:

a) a lamp, b) a cord electrically connected to said lamp, and c) a track adaptor electrically connected to said cord and engaged in said lighting track.

28. The device defined in claim 27, wherein said lighting track is a one circuit track.

29. The device defined in claim 27, wherein said lighting track is a two circuit track.

30. The device defined in claim 7, wherein said lighting track is a three circuit track.

31. A beam member for supporting a luminaire and a power take off, said beam member including:

a) a longitudinally extending base portion, b) a flange extending upwardly from one side of said longitudinally extending base portion, c) an upstanding wall projecting from the other side of said longitudinally extending base portion, d) a lateral platform portion projecting perpendicularly from said upstanding wall portion, said lateral platform portion including at least one mounting hole provided therein to accept at least one mounting rod or tube, and e) a second vertical wall portion projecting vertically upward from said lateral platform portion.

32. A beam member for supporting a luminaire and a power take off, said beam member including:

a) a longitudinally extending base portion, b) a flange extending upwardly from one side of said longitudinally extending base portion, c) an upstanding wall projecting from the other side of said longitudinally extending base portion, d) a lateral platform portion projecting perpendicularly from said upstanding wall portion, said lateral platform portion including at least one mounting hole provided therein to accept at least one mounting rod or tube, and e) a second vertical wall portion projecting vertically upward from said lateral platform portion, f) a lighting track mounted to said vertical wall, and g) a junction box electrically connected to said lighting track and mounted to said vertical wall portion of said beam member.

33. A beam member for supporting a luminaire and a power take off, said beam member including:

a) a longitudinally extending base portion, b) a flange projecting upwardly from one side of said longitudinally extending base portion, c) an upstanding wall portion projecting from the other side of said base portion and connected by a radius, and d) a platform portion extending perpendicularly from said upstanding wall portion, said platform portion including a C shaped channel portion.

34. The device defined in claim 33 and further including:

a) a lighting track mounted to said upstanding wall portion of said beam member, and b) a junction box electrically connected to said lighting track and mounted to said upstanding wall portion of said beam member.

* * * * *